US005846925A

United States Patent [19]

Wilson et al.

[11] Patent Number: 5,846,925

[45] Date of Patent: Dec. 8, 1998

[54] SUCCINIC ACID DERIVATIVE DEGRADABLE CHELANTS, USES AND COMPOSITIONS THEREOF

[75] Inventors: David A. Wilson, Richwood; Druce K. Crump, Lake Jackson, both of Tex.

[73] Assignee: The Dow Chemical Company, Midland, Mich.

[21] Appl. No.: 666

[22] Filed: Dec. 30, 1997

Related U.S. Application Data

[62] Division of Ser. No. 705,551, Aug. 29, 1996, Pat. No. 5,733,858.

[60] Provisional application No. 60/003,042, Aug. 30, 1995.

[51] Int. Cl.[6] ..... C11D 3/30; C11D 3/33

[52] U.S. Cl. ..... 510/499; 510/361; 510/363; 510/397; 510/398; 510/409; 510/434; 510/477; 510/488

[58] Field of Search ..... 510/499

[56] References Cited

U.S. PATENT DOCUMENTS

| | | | |
|---|---|---|---|
| 4,704,233 | 11/1987 | Hartman et al. | 252/527 |
| 5,562,085 | 10/1996 | Wilson et al. | 430/393 |
| 5,652,085 | 7/1997 | Wilson et al. | 430/393 |

FOREIGN PATENT DOCUMENTS

| | | | |
|---|---|---|---|
| 0 361 088 | 8/1989 | European Pat. Off. | C07C 229/24 |
| 0 567 126 A1 | 4/1993 | European Pat. Off. | G03C 7/42 |
| 757704 | 2/1953 | United Kingdom . | |
| 94/03572 | 2/1994 | WIPO | C11D 3/08 |
| 94/11099 | 5/1994 | WIPO | B01J 13/00 |
| 94/20599 | 9/1994 | WIPO | C11D 3/33 |
| 94/284694 | 12/1994 | WIPO | G03C 7/00 |

OTHER PUBLICATIONS

English translations of reference EP 0 361 088 A.

*Primary Examiner*—Paul Liberman
*Assistant Examiner*—Charles Boyer

[57] ABSTRACT

Solutions comprising at least one polyamino disuccinic acid and one or more polyamino monosuccinic acids are useful in gas conditioning (preferably as the iron chelate). The copper chelates are also useful in electroless copper plating. Another aspect of the invention includes the use of the aminosuccinic acid mixtures in laundry detergent compositions.

12 Claims, No Drawings

SUCCINIC ACID DERIVATIVE DEGRADABLE CHELANTS, USES AND COMPOSITIONS THEREOF

CROSS-REFERENCE TO RELATED APPLICATION

This application is a divisional of U.S. application Ser. No. 08/705,551 filed Aug. 29, 1996, now U.S. Pat. No. 5,733,858, which claims benefit from U.S. Provisional application Ser. No. 60/003,042 filed Aug. 30, 1995, now abandoned. This invention relates to chelants, particularly uses of certain synergistic combinations of degradable chelants.

BACKGROUND OF THE INVENTION

Chelants or chelating agents are compounds which form coordinate covalent bonds with a metal ion to form chelates. Chelates are coordination compounds in which a central metal atom is bonded to two or more other atoms in at least one other molecule (called ligand) such that at least one heterocyclic ring is formed with the metal atom as part of each ring.

Chelants are used in a variety of applications including food processing, soaps, detergents, cleaning products, personal care products, pharmaceuticals, pulp and paper processing, gas conditioning, water treatment, metalworking and metal plating solutions, textile processing solutions, fertilizers, animal feeds, herbicides, rubber and polymer chemistry, photofinishing, and oil field chemistry. Some of these activities result in chelants entering the environment. For instance, agricultural uses or detergent uses may result in measurable quantities of the chelants being in water. It is, therefore, desirable that chelants degrade after use.

Biodegradability, that is susceptibility to degradation by microbes, is particularly useful because the microbes are generally naturally present in environments into which the chelants may be introduced. Commonly used chelants like EDTA (ethylenediamine tetraacetic acid) are biodegradable, but at rates somewhat slower and under conditions considered by some to be less than optimum. (See, Tiedje, "Microbial Degradation of Ethylenediaminetetraacetate in Soils and Sediments," Applied Microbiology, Aug. 1975, pp. 327–329.) It would be desirable to have a chelating agent which degrades faster than EDTA or other commonly used chelants.

Biodegradation of chelants is of particular interest in many metal ion control applications. Examples include use of chelants in the following areas: electroless copper plating, prevention or removal of undesirable iron deposits, removal of organic stains from fabrics, scrubbing of $H_2S$ and/or $NO_x$ from gas streams via metal chelates, stabilizing peroxide in cellulosic bleaching systems, and others. However, finding a commercially useful biodegradable chelant for these applications has been difficult. The chelating agents that are most useful generally do not biodegrade in a desirable time (e.g. ethylenediaminetetraacetic acid, N-hydroxyethylethlyenediaminetriacetic acid, diethylenetriaminepentaacetic acid, cyclohexanediaminetetraacetic acid, and propylenediaminetetraacetic acid) all biodegrade less than 60% in 28 days using the OECD 301 B Modified Sturm Test.

It would be desirable to have a chelant, or a mixture of chelants, useful in metal ion control processes, where such chelant or mixture of chelants is greater than about 60 percent biodegradable within less than 28 days according to the OECD 301 B Modified Sturm Test.

SUMMARY OF THE INVENTION

A combination of chelants, or metal chelates thereof, comprising at least one polyamino disuccinic acid and one or more polyamino monosuccinic acids, or salts thereof have been found to be excellent for use in metal ion control applications where enhanced biodegradability is desired. It has been found that certain mixtures of chelants display unexpected metal ion control performance and ease of biodegradability In one aspect, the invention includes methods of electroless plating using various metals (especially copper) complexed with a mixture of chelants comprising at least one polyamino disuccinic acid and one or more polyamino monosuccinic acids, or salts thereof. It includes a method of electroless deposition of copper upon a non-metallic surface receptive to the deposited copper including a step of contacting the non-metallic surface with an aqueous solution comprising a soluble copper salt and at least one polyamino disuccinic acid and one or more polyamino monosuccinic acids, or salts thereof. Also included is a method of electroless copper plating which comprises immersing a receptive surface to be plated in an alkaline, autocatalytic copper bath comprising water, a water soluble copper salt, and at least one polyamino disuccinic acid and one or more polyamino monosuccinic acids, or salts thereof as the complexing agents for cupric ion. Additionally, there is an improvement in a process for plating copper on non-metallic surfaces, only selected portions of which have been pretreated for the reception of electroless copper, by immersing the surface in an autocatalytic alkaline aqueous solution comprising, in proportions capable of effecting electroless deposition of copper, a water soluble copper salt, a complexing agent for cupric ion, and a reducing agent for cupric ion, the improvement comprising using as the complexing agent for cupric ion, at least one polyamino disuccinic acid and one or more polyamino monosuccinic acids, or salts thereof. The invention includes a bath for the electroless plating of copper which comprises water, a water soluble copper salt, at least one polyamino disuccinic acid and one or more polyamino monosuccinic acids, or salts thereof as complexing agents for cupric ions, sufficient alkali metal hydroxide to result in a pH of from about 10 to about 14, and a reducing agent.

Another aspect of the invention includes a method for removing iron oxide deposits or organic stains from a surface including a step of contacting the deposits or stains with a solution comprising at least one polyamino disuccinic acid and one or more polyamino monosuccinic acids, or salts thereof.

Yet another aspect of the invention involves gas conditioning. In this aspect the invention includes a process of removing $H_2S$ from a fluid comprising contacting said fluid with an aqueous solution at a pH suitable for removing $H_2S$ wherein said solution contains at least one higher valence polyvalent metal chelate of at least one polyamino disuccinic acid and one or more polyamino monosuccinic acids, or salts thereof. Another aspect of the gas conditioning invention includes a process of removing $NO_x$ from a fluid comprising contacting the fluid with an aqueous solution of at least one lower valence state polyvalent metal chelate of at least one polyamino disuccinic acid and one or more polyamino monosuccinic acids, or salts thereof.

The present invention is also to a laundry detergent composition comprising (a) from about 1% to about 80% by weight of a detergent surfactant selected from nonionic, anionic, cationic, zwitterionic, and ampholytic surfactants and mixtures thereof; (b) from about 5% to about 80% by weight of at least one detergent builder; and (c) from about 0.1% to about 15% by weight of a combination of chelants comprising at least one polyamino disuccinic acid and one or more polyamino monosuccinic acids, or salts thereof.

In another aspect, the present invention is a liquid laundry detergent composition comprising (a) from about 10% to about 50% by weight of a detergent surfactant selected from nonionic, anionic, cationic, zwitterionic, and ampholytic surfactants and mixtures thereof; (b) from about 10% to about 40% by weight of at least one detergent builder; and (c) from about 0.1% to about 10% by weight of a combination of chelants comprising at least one polyamino disuccinic acid and one or more polyamino monosuccinic acids, or salts thereof.

The present invention is also to a granular laundry composition comprising (a) from about 5% to about 50% by weight of a detergent surfactant selected from nonionic, anionic, cationic, zwitterionic, and ampholytic surfactants and mixtures thereof; (b) from about 10% to about 40% by weight of at least one detergency builder; and (c) from about 0.1% to about 10% by weight of a combination of chelants comprising at least one polyamino disuccinic acid and one or more polyamino monosuccinic acids, or salts thereof.

The above laundry compositions are used in a method of laundering fabrics comprising contacting a fabric with an aqueous solution of the above noted laundry detergent compositions.

The present invention is also to a composition for chelating a metal comprising at least one polyamino discuccinic acid and at least one polyamino monosuccinic acid, or salts thereof.

DETAILED DESCRIPTION OF THE INVENTION

The present invention is to the use of a mixture of at least one polyamino disuccinic acid and one or more polyamino monosuccinic acids, also referred to herein as succinic acid mixtures. As used herein the term succinic acid includes salts thereof. It has been unexpectedly found that when a mixture of such compounds is used to chelate a metal ion, such as iron, said mixtures show a greater ability to chelate the metal ion and such complexes have a greater stability than what would be expected from the sum of the individual compounds. Such mixtures also show an unexpected increase in biodegradability as measured by the OECD 301B Modified Sturm Test.

Polyamino disuccinic acids are compounds having two or more nitrogen atoms wherein 2 of the nitrogens are bonded to a succinic acid (or salt) group, preferably only two nitrogen atoms each have one succinic acid (or salt) group attached thereto. The compound has at least 2 nitrogen atoms, and due to the commercial availability of the amine, preferably has no more than about 10 nitrogen atoms, more preferably no more than about 6, most preferably 2 nitrogen atoms. Remaining nitrogen atoms most preferably are substituted with hydrogen atoms. More preferably, the succinic acid groups are on terminal nitrogen atoms, most preferably each of which nitrogens also has a hydrogen substituent. Because of steric hindrance of two succinic groups on one nitrogen, it is preferred that each nitrogen having a succinic group has only one such group. Remaining bonds on nitrogens having a succinic acid group are preferably filled by hydrogens or alkyl or alkylene groups (linear, branched or cyclic including cyclic structures joining more than one nitrogen atom or more than one bond of a single nitrogen atom, preferably linear) or such groups having ether or thioether linkages, all of preferably from 1 to about 10 carbon atoms, more preferably from 1 to about 6, most preferably from 1 to about 3 carbon atoms, but most preferably hydrogen. More preferably, the nitrogen atoms are linked by alkylene groups, preferably each of from about 2 to about 12 carbon atoms, more preferably from about 2 to about 10 carbon atoms, even more preferably from about 2 to about 8, most preferably from about 2 to about 6 carbon atoms. The polyamino disuccinic acid compound preferably has at least about 10 carbon atoms and preferably has at most about 50, more preferably at most about 40, most preferably at most about 30 carbon atoms. The term "succinic acid" is used herein for the acid and salts thereof; the salts include metal cation (e.g. potassium, sodium) and ammonium or amine salts. Polyamino disuccinic acids useful in the practice of the invention are unsubstituted (preferably) or inertly substituted, that is substituted with groups that do not undesirably interfere with the activity of the polyamino disuccinic acid in a selected application. Such inert substituents include alkyl groups (preferably of from 1 to about 6 carbon atoms); aryl groups including arylalkyl and alkylaryl groups (preferably of from 6 to about 12 carbon atoms), and the like with alkyl groups preferred among these and methyl and ethyl groups preferred among alkyl groups. Inert substituents are suitably on any portion of the molecule, preferably on carbon atoms, more preferably on alkylene groups, e.g. alkylene groups between nitrogen atoms or between carboxylic acid groups, most preferably on alkylene groups between nitrogen groups.

Preferred polyamino disuccinic acids include ethylenediamine-N,N'-disuccinic acid, diethylenetriamine-N,N"-disuccinic acid, triethylenetetraamine-N,N'"-disuccinic acid, 1,6-hexamethylenediamine N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, and ethylenebis(oxyethylenenitrilo)-N,N'-disuccinic acid. The preferred polyamino disuccinic acid is ethylenediamine-N,N'-disuccinic acid.

Such polyamino disuccinic acids can be prepared, for instance, by the process disclosed by Kezerian et al. in U.S. Pat. No. 3,158,635 which is incorporated herein by reference in its entirety. Kezerian et al disclose reacting maleic anhydride (or ester or salt) with a polyamine corresponding to the desired polyamino disuccinic acid under alkaline conditions. The reaction yields a number of optical isomers, for example, the reaction of ethylenediamine with maleic anhydride yields a mixture of three optical isomers [R,R], [S,S] and [S,R] ethylenediamine disuccinic acid (EDDS) because there are two asymmetric carbon atoms in ethylenediamine disuccinic acid. These mixtures are used as mixtures or alternatively separated by means within the state of the art to obtain the desired isomer(s). Alternatively, [S,S] isomers are prepared by reaction of such acids as L-aspartic acid with such compounds as 1,2-dibromoethane as described by Neal and Rose, "Stereospecific Ligands and Their Complexes of Ethylenediaminedisuccinic Acid", *Inorganic Chemistry,* v. 7. (1968), pp. 2405–2412.

Polyamino monosuccinic acids are compounds having at least two nitrogen atoms to which a succinic acid (or salt) moiety is attached to one of the nitrogen atoms. Preferably the compound has at least 2 nitrogen atoms, and due to the commercial availability of the amine, preferably has no more than about 10 nitrogen atoms, more preferably no more than about 6, most preferably 2 nitrogen atoms. Remaining nitrogens atoms, those which do not have a succinic acid moiety attached, preferably are substituted with hydrogen atoms. Although the succinic acid moiety may be attached to any of the amines, preferably the succinic acid group is attached to a terminal nitrogen atom. By terminal it is meant the first or last amine which is present in the compound, irrespective of other substituents. The remaining bonds on the nitrogen having a succinic acid group are preferably filled by hydrogens or alkyl or alkylene groups (linear, branched or cyclic including cyclic structures joining more than one nitrogen atom or more than one bond of a single nitrogen atom, preferably linear) or such groups having ether or thioether linkages, all of preferably from 1 to about 10 carbon atoms, more preferably from 1 to about 6, most preferably from 1 to about 3 carbon atoms, but most preferably hydrogen. Generally the nitrogen atoms are linked by alkylene groups, each of from about 2 to about 12 carbon atoms, preferably from about 2 to about 10 carbon atoms, more preferably from about 2 to about 8, and most preferably from about 2 to about 6 carbon atoms. The polyamino monosuccinic acid compound preferably has at least about 6 carbon atoms and preferably has at most about 50, more preferably at most about 40, and most preferably at most about 30 carbon atoms. Polyamino monosuccinic acids useful in the practice of the invention are unsubstituted (preferably) or inertly substituted as described above for polyamino disuccinic acid compounds.

Preferred polyamino monosuccinic acids include ethylenediamine monosuccinic acid, diethylenetriamine monosuccinic acid, triethylenetetraamine monosuccinic acid, 1,6-hexamethylenediamine monosuccinic acid, tetraethylenepentamine monosuccinic acid, 2-hydroxypropylene-1,3-diamine monosuccinic acid, 1,2-propylenediamine monosuccinic acid, 1,3-propylenediamine monosuccinic acid, cis-cyclohexanediamine monosuccinic acid, trans-cyclohexanediamine monosuccinic acid and ethylenebis (oxyethylenenitrilo) monosuccinic acid. The preferred polyamino monosuccinic acid is ethylenediamine monosuccinic acid.

Such polyamino monosuccinic acids can be prepared for instance, by the process of Bersworth et al. in U.S. Pat. No. 2,761,874, the disclosure of which is incorporated herein by reference, and as disclosed in Jpn. Kokai Tokkyo Koho JP 57,116,031. In general, Bersworth et al. disclose reacting alkylene diamines and dialkylene triamines under mild conditions with maleic acid esters under mild conditions (in an alcohol) to yield amino derivatives of N-alkyl substituted aspartic acid. The reaction yields a mixture of the R and S isomers.

In a preferred embodiment, when the chelant-solution contains a mixture of a polyamino disuccinic acid and a polyamino monosuccinic acid, it is preferred that the polyamino substituent of the polyamino disuccinic acid and the polyamino monosuccinic acid are the same. Thus by way of example, if the polyamino disuccinic acid is ethylenediamine-N-N'-disuccinic acid, the polyamine monosuccinic acid is ethylenediamine monosuccinic acid.

The invention includes the use of iron complexes of a polyamino disuccinic acid and a polyamino monosuccinic acid in abatement of hydrogen sulfide and other acid gases and as a source of iron in plant nutrition. Similarly other metal complexes such as the copper, zinc and manganese complexes supply those trace metals in plant nutrition. The ferrous complexes are also useful in nitrogen oxide abatement.

Iron complexes used in the present invention are conveniently formed by mixing an iron compound with an aqueous solution of the succinic acid mixtures, or salts thereof. The pH values of the resulting iron chelate solutions are preferably adjusted with an alkaline material such as ammonia solution, sodium carbonate, or dilute caustic (NaOH). Water soluble iron compounds are conveniently used. Exemplary iron compounds include iron nitrate, iron sulfate, and iron chloride. The final pH values of the iron chelate solutions are preferably in the range of about 4 to 9, more preferably in the range of about 5 to 8. When an insoluble iron source, such as iron oxide, is used, the succinic acid compounds are preferably heated with the insoluble iron source in an aqueous medium at an acidic pH. The use of ammoniated amino succinic acid solutions are particularly effective. Ammoniated amino succinic acid chelants are conveniently formed by combining aqueous ammonia solutions and aqueous solutions or slurries of amino succinic acids in the acid (rather than salt) form.

Succinic acid mixtures are effective as chelants especially for metals such as iron and copper. Effectiveness as a chelant is conveniently measured by complexing the chelant with a metal such as copper such as by mixing an aqueous solution of known concentration of the chelant with an aqueous solution containing copper (11) ions of known concentration and measuring chelation capacity by titrating the chelant with copper in the presence of an indicator dye.

The succinic acid compounds are preferably employed in the form of water-soluble salts, notably alkali metal salts, ammonium salts, or alkyl ammonium salts. The alkali metal salts can involve one or a mixture of alkali metal salts although the potassium or sodium salts, especially the partial or complete sodium salts of the acids are preferred.

Succinic acid mixtures are also useful, for instance, in food products vulnerable to metal-catalyzed spoilage or discoloration; in cleaning products for removing metal ions, that may reduce the effectiveness, appearance, stability, rinsibility, bleaching effectiveness, germicidal effectiveness or other property of the cleaning agents; in personal care products like creams, lotions, deodorants and ointments to avoid metal-catalyzed oxidation and rancidity, turbidity, reduced shelf-life and the like; in pulp and paper processing to enhance or maintain bleaching effectiveness; in pipes, vessels, heat exchangers, evaporators, filters and the like to avoid or remove scaling, in pharmaceuticals; in metal working; in textile preparation, desizing, scouring, bleaching, dyeing and the like; in agriculture as in chelated micronutrients or herbicides; in polymerization or stabilization of polymers; in the oil field such as for drilling, production, recovery, hydrogen sulfide abatement and the like.

The chelants can be used in industrial processes whenever metal ions such as iron or copper are a nuisance and are to be prevented.

The succinic acid mixtures are also useful in processes for the electroless deposition of metals such as nickel and copper. Electroless plating is the controlled autocatalytic deposition of a continuous film of metal without the assistance of an external supply of electrons such as described in U.S. Pat. Nos. 3,119,709 (Atkinson) and 3,257,215 (Schneble et al.). Non-metallic surfaces are pretreated by means within the skill in the art to make them receptive or autocatalytic for deposition. All or selected portions of a surface are suitably pretreated. Complexing agents are used to chelate a metal being deposited and prevent the metal from being precipitated from solution (i.e. as the hydroxide and the like). Chelating a metal renders the metal available to the reducing agent which converts the metal ions to metallic form. Growth of electroless plating can be attributed in part to growth of the electronics industry, especially for printed circuits. Electroless plating solutions are complex and contain a variety of ingredients. For example, an illustrative electroless copper solution would advantageously contain copper salts, a reducing agent, a material for the adjustment of the pH, a complexing agent, a buffer, and various additives to control stability, film properties, deposition rates, and the like. Typical copper salts include the water soluble salts such as copper sulfate, chloride, nitrate and acetate. Other organic and inorganic salts of copper may also be used. Typical of the reducing agents that can be used in alkaline electroless copper plating baths are formaldehyde and formaldehyde precursors such as glyoxal and paraformaldehyde. Borohydrides such as sodium or potassium borohydride and boranes such as amino boranes are also useful. In acidic copper solutions, hypophosphites such as sodium or potassium hypophosphite are used. On the acidic side, acids such as sulfuric may be employed. The pH adjustment is used to regulate the plating potential of the bath. Mixtures of the succinic acid compounds are preferably used to chelate the copper. A typical aqueous bath utilizing the succinic acid mixtures advantageously contains from about 0.002 to about 0.60 moles of a water soluble copper salt, the succinic acid mixtures at a molar ratio of approximately 1 to 2 times that required to complex the copper, an alkali metal hydroxide in sufficient amounts to give a pH of from about 10 to about 14, and e.g. formaldehyde from about 0.03 to about 1.3 moles per liter. Used plating solutions, especially copper plating solutions, may be difficult to treat since they contain strong complexes such as EDTA (ethylenediaminetetraacetic acid) that are slowly biodegraded. The use of the more biodegradable chelant combinations described herein comprising a polyamino disuccinic acid and a polyamino monosuccinic acid and/or a monoamino monosuccinic acid, such as ethylenediamine N,N'-disuccinic acid in combination with ethylenediamine N-monosuccinic acid, are particularly useful in this regard.

In the polymerization of rubber, mixtures of the succinic acid compounds are suitably used for preparing the redox catalysts used therein. They additionally prevent the precipitation of such compounds as iron hydroxide in an alkaline polymerization medium.

In the textile industry, the chelants are suitably used for removing metal traces during the manufacture and dyeing of natural and synthetic fibers, thereby preventing many problems, such as dirt spots and stripes on the textile material, loss of luster, poor wettability, unlevelness and off-shade dyeings.

Exemplary of various other uses of succinic acid mixtures are applications in pharmaceuticals, cosmetics and foodstuffs where metal catalyzed oxidation of olefinic double bonds and hence rancidification of goods is prevented. The chelates are also useful as catalysts for organic syntheses (for example air oxidation of paraffins, hydroformylation of olefins to alcohols).

Metal chelates are important in agriculture because they supply micronutrients (trace metals such as iron, zinc, manganese, and copper) which are vital in the metabolism of both plants and animals. Plant problems previously ascribed to disease and drought are now recognized as possible symptoms of micronutrient deficiencies. Today these deficiencies are generally considered to be caused by (1) the trend toward higher analysis fertilizers containing fewer "impurities"; soils which had been adequately supplied with trace metals from these "impurities" have now become deficient; (2) intensified cropping practices which place a severe demand on the soil to supply micronutrients; to maintain high yields, supplementary addition of trace metals is now necessary; (3) high phosphorus fertilization, which tends to tie up metals in the soil in a form unavailable to the plant; and (4) the leveling of marginal land for cultivation, which often exposes subsoils deficient in micronutrients. The metal chelates of aminocarboxylates such as EDTA and HEDTA are commonly used to chelate micronutrients for agricultural use. The iron, copper, zinc, and manganese chelates of the succinic acid compound mixtures can be used to deliver these metals to the plant. Because of the excellent solubility, these metal chelates are more readily utilized by the plant than are the inorganic forms of the metals. This is especially true in highly competitive ionic systems. As a result, the micronutrients that are chelated to the succinic acid mixtures are more efficient than when compared to the inorganic sources. The chelates of iron, manganese, copper, and zinc with the biodegradable succinic acid mixtures comprising ethylenediamine N,N'-disuccinic acid and ethylenediamine N-monosuccinic acid are particularly preferred. Biodegradable chelants would have less residence time in soil.

Further fields of application for the succinic acid mixtures include gas washing, conditioning or scrubbing (of e.g. flue, geothermal, sour, synthesis, process, fuel, or hydrocarbon gas) to remove at least one acidic gas, preferably the removal of $NO_x$ from flue gases, $H_2S$ oxidation and metal extraction. Polyvalent metal chelates of the succinic acid mixtures are particularly useful in removing $H_2S$ from a fluid, particularly a gas, containing $H_2S$, by (directly or indirectly) contacting the fluid with the chelates of a polyvalent metal in a higher valence state such that sulfur is formed along with the chelates of the metal in a lower valence state. The chelates of any oxidizing polyvalent metal capable of being reduced by reaction with $H_2S$ or hydrosulfide and/or sulfide ions and, preferably which can be regenerated by oxidation, are suitable. Preferably the chelates are water soluble. Exemplary metals include lead, mercury, nickel, chromium, cobalt, tungsten, tin, vanadium, titanium, tantalum, platinum, palladium, zirconium, molybdenum, preferably iron, copper, or manganese, most preferably iron.

Succinic acid mixtures are suitably used in any process of removal of $H_2S$ within the skill in the art such as those exemplified by U.S. Pat. Nos. 4,421,733; 4,614,644; 4,629,608; 4,683,076; 4,696,802; 4,774,071; 4,816,238; and 4,830,838, which are incorporated by reference herein. The polyvalent metal chelates are readily formed in aqueous solution by reaction of an appropriate salt, oxide or hydroxide of the polyvalent metal and the chelating agents in the acid form or an alkali metal or ammonium salt thereof.

Preferably contact of $H_2S$, hydrosulfide, and/or sulfide with the chelates takes place at a pH of from about 6 to about 10. The more preferred range is from about 6.5 to about 9 and the most preferred range of pH is from about 7 to about 9. In general, operation at the highest portion of the range is preferred in order to operate at a high efficiency of hydrogen sulfide absorption. Since the hydrogen sulfide is an acid gas, there is a tendency for the hydrogen sulfide to lower the pH of the aqueous alkaline solution. Lower pH is preferable in the presence of carbon dioxide to reduce absorption thereof. Optimum pH also depends upon stability of a particular polyvalent metal chelate. At the pH values below about 6 the efficiency of hydrogen sulfide absorption is so low so as to be generally impractical. At pH values greater than 10, for instance with iron as the polyvalent metal, the precipitation of insoluble iron hydroxide may occur resulting in decomposition of the iron chelate. Those skilled in the art can ascertain a preferred pH for each operating situation.

Buffering agents optionally useful as components of aqueous alkaline scrubbing solutions of the invention include those which are capable of maintaining the aqueous alkaline solution at a pH generally in a operating pH range of about 6 to about 10. The buffering agents are advantageously water soluble at the concentration in which they are effective. Examples of suitable buffering agents include the ammonium or alkali metal salts of carbonates, bicarbonates, or borates, including sodium carbonate, bicarbonate or sodium borate, particularly carbonates and bicarbonates when used in the presence of $CO_2$ (carbon dioxide).

The temperatures employed in a contacting or absorption-contact zone are not generally critical, except that the reaction is carried out below the melting point of sulfur. In many commercial applications, absorption at ambient temperatures is desired. In general, temperatures from about 10° C. to about 80° C. are suitable, and temperatures from about 20° C. to about 45° C. are preferred. Contact times conveniently range from about 1 second to about 270 seconds or longer, with contact times of 2 seconds to 120 seconds being preferred.

Suitable pressure conditions vary widely, depending on the pressure of the gas to be treated. For example, pressures in a contacting zone may vary from one atmosphere up to one hundred fifty or even two hundred atmospheres, with from one atmosphere to about one hundred atmospheres preferred.

In $H_2S$ removal, preferably at least an amount of chelate in a higher valence state stoichiometric with the $H_2S$ to be removed is used. Preferred mole ratios of chelating agents to $H_2S$ are from about 1:1 to about 15:1, more preferably from about 2:1 to about 5:1.When chelates in both higher and lower valence states are present, it is generally preferable to maintain a concentration of the lower valence state chelates of at least about 5 times the concentration of that in the higher valence state. When, for instance iron chelates are used, they are preferably present in an amount from about 100 to about 100,000 ppm iron in the higher valence state most preferably from about 1000 to about 50,000 ppm by weight iron in the higher valence state. The circulation rate of the chelate solutions depends upon the hydrogen sulfide level in the $H_2S$ containing fluid. In general, the circulation rate should be sufficient to provide from about 1 to about 6 moles and preferably about 2–4 moles of high valence (e.g. ferric) chelate products for every mole of $H_2S$ entering the reaction zone. The contact time of the reactants should be at least about 0.05 second or more and preferably in the range from about 0.02 to about 1.0 seconds.

The succinic acid mixtures are preferably used in combination with additives such as rate enhancers (or catalysts, e.g. for conversion of $H_2S$ to sulfur) and/or stabilizers for the chelates. Cationic polymeric catalysts are advantageous and include polyethyleneamines, poly(2-hydroxypropyl-1-N-methylammonium chloride) and the 1,1-dimethyl analog, poly[N-(dimethylaminomethyl) acrylamide], poly(2-vinylimidazolinum bisulfate), poly(diallyldimethyl ammonium chloride) and poly(N-dimethyl aminopropyl)-methacrylamide. These cationic polymers are well known and are commercially available under various trade names. See, for example, *Commercial Organic Flocculants* by J. Vostrcil et al Noyes Data Corp. 1972 which is incorporated by reference herein. Other useful cationic catalysts are set forth in *J. Macromol. Science-Chem.* A4 pages 1327–1417 (1970) which is also incorporated by reference herein. Preferred catalysts include polyethylene amines and poly (diallyldimethyl ammonium chloride). Preferred concentration ranges for the polymeric catalysts are from about 0.75 to about 5.0 weight percent, and from about 1.0 to about 3.0 weight percent is the most preferred range. The amount of polymeric catalyst is sufficient to provide a weight ratio of iron or other polyvalent metal in the range from 0.2 to 10:1. Concentrations of from about 10 to about 25 ppm in solution are preferred. Stabilizing agents include, e.g. bisulfite ions such as sodium, potassium, lithium, ammonium bisulfite and mixtures thereof. They are used in stabilizing amounts, i.e. amounts sufficient to reduce or inhibit rate of degradation of the chelates, preferably from about 0.01 to about 0.6 equivalents per liter of solution, more preferably from about 0.05 to about 0.3 equivalents/liter.

After the chelates of lower valence state are produced from that of higher valence state, they are preferably oxidized back to the higher valence state and recycled. Oxidation is suitably by any means within the skill in the art, e.g. electrochemically, but preferably by contact with an oxygen-containing gas, e.g. air. If $CO_2$ is absorbed, it is preferably removed before contact with the oxygen-containing gas. The oxygen (in whatever form supplied) is advantageously supplied in a stoichiometric equivalent or excess with respect to the amount of lower valence state metal ion of the chelates present in the mixture. Preferably, the oxygen is supplied in an amount from about 1.2 to 3 fold excess and in a concentration of from about 1 percent to about 100 percent by volume, more preferably from about 5 percent to about 25 percent by volume. Temperatures and pressures are suitably varied widely, but generally those used in the contacting zone(s) are preferred, preferably temperatures of from about 10° C. to about 80° C. more preferable from about 20° C. to about 45° C. with pressures from about 0.5 atmosphere to about 3 or 4 atmospheres preferred. Mild oxidizing conditions are generally preferred to avoid degradation of the chelating agents. Such conditions are within the skill in the art.

Sulfur produced by reaction of $H_2S$ with the polyvalent metal chelates is optionally solubilized, e.g. by oxidation. Oxidation is suitably by any means within the skill in the art. When $SO_2$ is present or easily generated by oxidation of $H_2S$ (e.g. using oxygen or electrochemical means) it is a preferred oxidizing agent to produce, e.g. thiosulfates from the sulfur. Other suitable oxidizing agents include e.g. alkali metal or ammonium salts of inorganic oxidizing acids such as perchloric, chloric, hypochlorous, and permanganic acids. Otherwise, the sulfur is optionally recovered by means within the skill in the art including flocculation, settling, centrifugation, filtration, flotation and the like.

Processes of the invention include, for instance: a process for removing at least a portion of $H_2S$ from a fluid stream containing $H_2S$ which comprises (A) contacting said fluid stream (optionally in a first reaction zone) with an aqueous solution at a pH range suitable for removing $H_2S$ wherein said solution comprises higher valence polyvalent metal chelates of a polyamino disuccinic acid in combination with a polyamino monosuccinic acid and/or a monoamino monosuccinic acid whereby said higher valence polyvalent metal chelates are reduced to lower valence polyvalent metal chelates. Optionally the aqueous solution additionally comprises an oxidizing agent capable of oxidizing elemental sulfur to soluble sulfur compounds, and/or one or more water soluble cationic polymeric catalysts and/or a stabilizing amount of a stabilizing agent each as bisulfite ion.

The process optionally includes at least one additional step such as:

(B) contacting said solution containing the lower valence polyvalent chelated in a second reaction zone with an oxygen-containing gas stream whereby said chelates are reoxidized;

(C) recirculating said reoxidized solution back to said first reaction zone;

(D) feeding said aqueous solution from said oxidation zone to a sulfur recovery zone;

(E) removing from said aqueous solution at least a portion of said sulfur and thereafter;

(F) regenerating the aqueous admixture in a regeneration zone to produce a regenerated reactant;

(G) returning aqueous admixture containing regenerated reactant from the regeneration zone to the contacting zone;

(H) incinerating hydrogen sulfide to form sulfur dioxide;

(I) selectively absorbing said sulfur dioxide in an alkaline aqueous solution without substantial carbon dioxide absorption to form a solution of sulfites essentially free of insoluble carbonates;

(J) contacting said sulfur with said sulfites to form soluble sulfur compounds;

(K) recirculating said reoxidized polyvalent metal chelates back to said fluid stream/aqueous chelates solution contacting step; and/or (L) condensing geothermal steam in a reaction zone, preferably in said first reaction zone, for contacting said reduced polyvalent metal chelates.

Compositions of the invention, thus, include aqueous solutions of polyvalent metal chelates of the invention (in one or more oxidation states) with at least one of: $H_2S$, sulfide or bisulfide ions, rate enhancers such as poly (dimethyldiallyl ammonium chloride) and/or polyethyleneamines, and/or stabilizers such as bisulfite ions.

Similarly, succinic acid mixtures are used in removal of nitrogen oxides, preferably nitric oxide (NO), from fluids containing them. For instance, nitrogen oxides ($NO_x$) and $SO_2$ can be removed from flue gas streams by absorbing the $SO_2$ using an absorbent or reactant therefor, particularly an amine based absorbent such as a nitrogen-containing heterocyclic compound preferably having at least one carbonyl group such as a piperazinone; piperidinone, piperidine, piperazine or triazine having a carbonyl group; hydantoin; cyclic urea, oxazolidone or morpholinone in conjunction with a chelate of a polyvalent metal. Representative metal ions are chromium, cobalt, copper, iron, lead, manganese, mercury, molybdenum, nickel, palladium, platinum, tin, titanium, tungsten, and vanadium; preferably iron, copper, and/or nickel all preferably with a valence of +2, the more preferably iron, most preferably iron in the ferrous state. Such chelates are conveniently prepared by admixing a water soluble salt of the metal, such as, a sulfate or acetate with a water soluble form of the chelating agents, e.g. a salt, advantageously in water. The chelates are useful in any process within the skill in the art such as those disclosed in U.S. Pat. Nos. 4,732,744 to Chang et al.; 4,612,175 to Harkness et al.; 4,708,854 to Grinstead; 4,615,780 to Walker; 4,126,529 to DeBerry; 4,820,391 to Walker; and 4,957,716 to Cichanowicz et al. When an $SO_2$ absorbent is used, it is preferably regenerated, more preferably thermally regenerated, and preferably recycled. The concentration of $NO_X$ in the fluid (directly or indirectly) contacting the chelates is preferably from about 1 ppm to about 15,000 ppm by volume such as is found, for instance, in flue gases from burning e.g. coal.

Whether used with an absorbent for $SO_2$ or not, the metal chelates are advantageously present in the solution which contacts the $NO_X$ containing fluid at a metal ion concentration greater than about 100 ppm with a total chelating agent to metal ion molecular ratio of greater than or equal to one. The metal chelates are preferably present at a metal ion concentration of about 1,000 to about 10,000 ppm and a chelating agent to metal ion molecular ratio between about 1:1 and about 10:1. The optimum amounts depend on the chelating agents generally with preferred ratios between about 1:1 and to about 5:1.

An absorber is suitably operated at a temperature of from about 0° to about 120° C., but is preferably operated at a temperature of from about 5° to about 95° C. In the process, both absorber and (optionally) a stripper are typically operated at a pressure of from about atmospheric to about 10 atmospheres (e.g. 0 to about 69 Pa gauge), however, atmospheric pressure is preferred for the convenience of lower equipment and operating costs and reduced $SO_2$ absorbent losses. Higher temperatures and pressures are not deleterious so long as they are below the decomposition temperature of the chelates and absorbent, if present. The absorber is preferably maintained at a pH between about 3 and about 8 to retain $NO_x$ absorbence in the absorber.

Chelates absorb $NO_x$ or act as stoichiometric reactants to increase the solubility of $NO_x$ in aqueous solution. Preferably sulfite and/or bisulfite ions collectively referred to herein as "sulfites" are also present. Such ions react with the $NO_X$-chelate complex to form iminodisulfonate salts and free the chelate for $NO_x$ absorption. Examples of suitable soluble sulfite salts include sodium, potassium, lithium, magnesium and/or ammonium sulfite and/or bisulfite. When $SO_2$ is present, $SO_2$ in aqueous solution forms sulfurous acid, and the concentration of sulfites in the absorbent is generally sufficient for iminodisulfonate formation without replenishment, but sulfites may be added, if necessary, to maintain a concentration of at least 0.05 to about 1 g-moles/l absorbent, preferably at least about 0.1 g-moles/l. A sulfite salt is, thus, preferably present with the chelate.

Alternatively, as described in U.S. Pat. No. 4,957,71 6, which is incorporated herein by reference in its entirety, the chelates promote absorption of $NO_X$ which may be converted to such compounds as $HNO_2$ and $HNO_3$ which react with $HSO_3$, if present, to form hydroxylamine-disulfonate ($HON(SO_3H)_2$, abbreviated HADS) and related compounds, which are preferably subsequently converted to soluble ammonium and sulfate ions advantageously at a pH of about 4.2 or less, preferably about 4. More preferably the ammonium ions are subsequently removed, e.g. by absorption, and most preferably, the sulfate ions are precipitated.

In removing $NO_X$ from a fluid, the polyvalent metal chelates are oxidized from a lower to a higher valence state. The lower valence metal chelates are preferably replenished, e.g. by replacement of the polyvalent metal ion of the chelates, but more preferably by reduction of the metal by any means within the skill in the art, such as by contact with a reducing agent, or preferably by electrochemical means (at a cathode). The chelate is, then, preferably recycled.

When electrochemical regeneration is used, the solution containing the higher valence polyvalent metal chelates (which solution is preferably first (advantageously thermally) stripped of $SO_2$) is preferably directed to a cathode compartment of an electrochemical cell comprised of an anode in an anode compartment separated, preferably by a membrane, from a cathode in a cathode compartment. An electrical potential is imposed across the anode and cathode to reduce inactive oxidized chelates to an active state. Preferably, an anionic exchange membrane is used. Heat stable amine salts may also be converted to free amine sorbent in the cathode compartment and soluble salt anions diffuse from the cathode compartment through the anion exchange membrane into the anode department. Preferably, in a further step, regenerated absorbent solution from the cathode compartment is recycled to the $NO_x$ containing fluid contacting step. The process more preferably additionally comprises a step of adjusting the pH of the regenerated recycle absorbent to from about 3 to about 8.

Compositions of the invention, thus, include aqueous solutions of the polyvalent metal polyamino disuccinic acids in combination with a polyamino monosuccinic acid with at least one of $NO_X$, at least one (water soluble) sulfite, or at least one absorbent for $SO_2$. Mixtures of the chelates in higher and lower valence states and mixtures of the chelate with the chelate-$NO_X$ complex are also aspects of the instant invention.

Processes of the invention, thus, include a process-for removing at least a portion of $NO_X$, preferably NO, from a fluid containing $NO_X$, said fluid preferably also containing $SO_2$ and said fluid preferably being a gas, but suitably being a liquid, suspension, condensate and the like comprising the step of (A) (directly or indirectly) contacting the fluid with an aqueous solution comprising lower valence state polyvalent metal chelates of a polyamino disuccinic acid in combination with a polyamino monosuccinic acid and optionally additionally containing an absorbent for $SO_2$ and/or a sulfite.

The process optionally additionally comprises at least one of the following steps:

(B) thermally stripping sulfur dioxide from an $SO_2$-rich absorbent solution to obtain an $SO_2$-lean absorbent solution;

(C) directing the absorbent solution to a cathode compartment in an electrochemical cell, said cell having an anode in an anode compartment separated (preferably by a membrane) from a cathode in said cathode compartment, and imposing an electrical potential across said anode and said cathode to reduce oxidized chelates in said cathode compartment to obtain a regenerated absorbent solution;

(D) recycling said regenerated absorbent solution to contacting step (A);

(E) converting heat stable amine salts into free amine absorbent in said cathode compartment;

(F) separating salt anions from said cathode compartment through said anionic exchange membrane into said anode compartment;

(G) circulating an aqueous electrolyte solution through said anode compartment;

(H) periodically refreshing said electrolyte to eliminate byproduct salts in said anode compartment;

(I) adjusting said regenerated absorbent solution to a pH of from about 3 to about 8 for a recycling step;

(J) (when HADS is formed) mixing at least a portion of hydroxylaminedisulfonate in a reaction zone in an aqueous environment of pH of 4.2 or less, thereby converting said hydroxylaminedisulfonate to ammonium ions and sulfate ions in a second aqueous solution;

(K) contacting said second aqueous solution with a second ammonium ion-absorbing sorbent suitable for removing ammonium ions from said second aqueous solution and separating said second sorbent from said second aqueous solution;

(L) eluting said second sorbent and exposing the eluted ammonium ions or ammonia to nitrogen oxides at a temperature sufficient to form nitrogen and water therefrom; and/or (M) removing said sulfate ions from said second aqueous solution by forming a sulfate salt precipitate.

Succinic acid mixtures are also useful in laundry detergents, particularly laundry detergents containing a detergent surfactant and builder. The mixtures of the succinic acids facilitate the removal of organic stains such as tea stains, grape juice stains and various food stains from fabrics during laundering operations. The stains are believed to contain metals such as copper and iron. The succinic acid mixtures are very effective in chelating these metals and thus aids in the removal of the troublesome stain. The compositions comprise from about 1% to about 80% by weight of a detergent surfactant, preferably from about 10% to about 50%, selected from nonionic surfactants, anionic surfactants, cationic surfactants, zwitterionic surfactants, ampholytic surfactants and mixtures thereof; from about 5% to about 80% by weight of a detergent builder, preferably from about 10% to about 50%; and from about 0.1% to about 15% by weight of amino succinic acids, preferably from about 1% to about 10%, or alkali metal, alkaline earth, ammonium or substituted ammonium salt thereof, or mixtures thereof.

When used in detergent applications, including dishwashing compositions, the molar ration of the polyamino disuccinic acid to the polyamino disuccinic acid to the polyamino monosuccinic acid is from about 99:1 to about 5:95.

Nonionic surfactants that are suitable for use in the present invention include those that are disclosed in U.S. Pat. No. 3,929,678 (Laughlin et al.), incorporated herein by reference. Included are the condensation products of ethylene oxide with aliphatic alcohols, the condensation of ethylene oxide with the base formed by the condensation of propylene oxide and propylene glycol or the product formed by the condensation of propylene oxide and ethylendiamine. Also included are the various polyethylene oxide condensates of alkyl phenols and various amine oxide surfactants.

Anionic surfactants that are suitable for use are described in U.S. Pat. No. 3,929,678. These include sodium and potassium alkyl sulfates; various salts of higher fatty acids, and alkyl polyethoxylate sulfates.

Cationic surfactants that may be used are described in U.S. Pat. No. 4,228,044 (Cambre), incorporated herein by reference. Especially preferred cationic surfactants are the quaternary ammonium surfactants.

In addition, ampholytic and zwitterionic surfactants such as those taught in U.S. Pat. No. 3,929,678 can be used in the present invention.

Suitable builder substances are for example: wash alkalis, such as sodium carbonate and sodium silicate, or complexing agents, such as phosphates, or ion exchangers, such as zeolites, and mixtures thereof. These builder substances have as their function to eliminate the hardness ions, which come partially from the water, partially from dirt or textile material, and to support the surfactant action. In addition to the above mentioned builder substances, the builder component may further contain cobuilders. In modern detergents, it is the function of cobuilders to undertake some of the functions of phosphates, e.g. sequestration, soil antiredeposition and primary and secondary washing action.

The builder components may contain for example water-insoluble silicates, as described for example in German Laid-Open Application DE-OS No. 2,412,837, and/or phosphates. As phosphate it is possible to use pyrophosphates, triphosphates, higher polyphosphates and metaphosphates. Similarly, phosphorus-containing organic complexing agents such as alkanepolyphosphonic acids, amino- and hydroxy-alkanepolyphosphonic acids and phosphonocarboxylic acids, are suitable for use as further detergent ingredients generally referred to as stabilizers or phosphonates. Examples of such detergent additives are the following compounds: methanediphosphonic acid, propane-1,2,3-triphosphonic acid, butane-1,2,3,4-tetraphosphonic acid, polyvinylphosphonic acid, 1-aminoethane,-1,1-diphosphonic acid, aminotrismethylenetriphosphonic acid, methylamino- or ethylamino-bismethylenediphosphonic acid, ethylenediaminetetramethylenephosphonic acid, diethylenetriaminopentamethylenephosphonic acid, 1-hydroxyethane-1,1-diphosphonic acid, phosphonoacetic and phosphonopropionic acid, copolymers of vinylphosphonic acid and acrylic and/or maleic acid and also partially or completely neutralized salts thereof.

Further organic compounds which act as chelants for calcium that may be present in detergent formulations are polyearboxylic acids, hydroxycarboxylic acids and aminocarboxylic acids which are usually used in the form of their water-soluble salts.

Examples of polycarboxylic acids are dicarboxylic acids of the general formula HOOC—$(CH_2)_m$—COOH where m is 0–8, and maleic acid, methylenemalonic acid, citraconic acid, mesaconic acid, itaconic acid, noncyclic polycarboxylic acids having 3 or more carboxyl groups in the molecule, e.g. tricarballylic acid, aconitic acid, ethylenetetracarboxylic acid, 1,1,3- propanetricarboxylic acid, 1,1,3,3,5,5-pentanehexacarboxylic acid, hexanehexacarboxylic acid, cyclic di- or poly-carboxylic acids ( e.g. cyclopentanetetracarboxylic acid, cyclohexanehexacarboxylic acid, tetrahydrofurantetracarboxylic acid, phthalic acid, terephthalic acid, benzene-tricarboxylic, -tetra-carboxylic or -pentacarboxylic acid) and mellitic acid.

Examples of hydroxymonocarboxylic and hydroxypolycarboxylic acids are glycollic acid, lactic acid, malic acid, tartronic acid, methyltartronic acid, gluconic acid, glyceric acid, citric acid, tartaric acid and salicylic acid.

Examples of aminocarboxylic acids are glycine, glycylglycine, alanine, asparagine, glutamic acid, aminobenzoic acid, iminodiacetic acid, iminotriacetic acid, hydroxyethyliminodiacetic acid, ethylenediaminetetraacetic acid, hydroxyethylethylenediaminetriacetic acid, diethylenetriaminepentaacetic acid and higher homologues which are prepared by polymerization of an N-aziridylcarboxylic acid derivative, for example of acetic acid, succinic acid or tricarballylic acid, and subsequent hydrolysis, or by condensation of polyamines having a molecular weight of from 500 to 10,000 with salts of chloroacetic or bromoacetic acid.

Preferred cobuilder substances are polymeric carboxylates. These polymeric carboxylic acids include the carboxymethyl ethers of sugars, of starch and of cellulose. Zeolites and phosphates are also useful.

Particularly important polymeric carboxylic acids are for example the polymers of acrylic acid, maleic acid, itaconic acid, mesaconic acid, aconitic acid, methylenemalonic acid, citraconic acid and the like, the copolymers between the aforementioned carboxylic acids, for example a copolymer of acrylic acid and maleic acid in a ration of 70:30 and having a molecular weight of 70,000, or copolymers thereof with ethylenically unsaturated compounds, such as ethylene, propylene, isobutylene, vinyl methyl ether, furan, acrolein, vinyl acetate, acrylamide, acrylonitrile methacrylic acid, crotonic acid and the like, e.g. the 1:1 copolymers of maleic anhydride and methyl vinyl ether having a molecular weight of 70,000 or the copolymers of maleic anhydride and ethylene and/or propylene and/or furan.

The cobuilders may further contain soil antiredeposition agents which keep the dirt detached from the fiber in suspension in the liquid and thus inhibit graying. Suitable for this purpose are water-soluble colloids usually of an organic nature for example the water-soluble salts of polymeric carboxylic acids, glue, gelatin, salts of ethercarboxylic acids or ethersulfonic acids of starch and of cellulose or salts of acid sulfates of cellulose and of starch. Even water-soluble polyamides containing acid groups are suitable for this purpose. It is also possible to use soluble starch products and starch products other than those mentioned above, for example degraded starch, aldehyde starches and the like. Polyvinylpyrrolidone is also usable.

Bleaching agents that can be used are in particular hydrogen peroxide and derivatives thereof or available chlorine compounds. Of the bleaching agent compounds which provide $H_2O_2$ in water, sodium perborate hydrates, such as $NaBO_2.H_2O_2.3H_2O$ and $NaBO_2.H_2O_2$ and percarbonates such as 2 $Na_2CO_3.3H_2O_2$, are of particular importance. These compounds can be replaced in part or in full by other sources of active oxygen, in particular by peroxyhydrates, such as peroxyphosphonates, citrate perhydrates, urea, $H_2O_2$-providing peracid salts, for example caroates, perbenzoates or peroxyphthalates or other peroxy compounds.

Aside from those according to the invention, customary water-soluble and/or water-insoluble stabilizers for peroxy compounds can be incorporated together with the former in amounts from 0.25 to 10 percent by weight, based on the peroxy compound. Suitable water-insoluble stabilizers are the magnesium silicates $MgO:SiO_2$ from 4:1 to 1:4, preferably from 2:1 to 1:2, in particular 1:1, in composition, usually obtained by precipitation from aqueous solutions. Other alkaline earth metals of corresponding composition are also suitably used.

To obtain a satisfactory bleaching action even in washing at below 80° C., in particular in the range from 60° C. to 40° C., it is advantageous to incorporate bleach activators in the detergent, advantageously in an amount from 5 to 30 percent by weight, based on the $H_2O_2$-providing compound.

Activators for peroxy compounds which provide $H_2O_2$ in water are certain N-acyl and O-acyl compounds, in particular acetyl, propionyl or benzyl compounds, which form organic peracids with $H_2O_2$ and also carbonic and pyrocarbonic esters. Useful compounds are inter alia:

N-diacylated and N,N'-tetraacylated amines, e.g. N,N,N',N'-tetraacetyl-methylenediamine or -ethylenediamine, N,N-diacetylaniline and N,N-diacetyl-p-toluidine, and 1,3-diacylated hydantoins, alkyl-N-sulfonyl-carboxamides, N-acylated hydrazides, acylated triazoles or urazoles, e.g. monoacetylmaleohydrazide, O,N,N-trisubstituted hydroxylamines, e.g. O-benzoyl-N,N-succinylhydroxylamine, O-acetyl-N,N-succinylhydroxylamine, O-p-methoxybenzoyl-N, N-succinylhydroxylamine O-p-nitrobenzoyl-N, N-succinylhydroxylamine and O,N,N-triacetylhydroxylamine, carboxylic anhydrides, e.g. benzoic anhydride, m-chlorobenzoic anhydride, phthalic anhydride and 4-chlorophthalic anhydride, sugar esters, e.g. glucose pentaacetate, imidazolidine derivatives, such as 1,3-diformyl -4,5-diacetoxyimidazolidine, 1,3-diacetyl-4,5-diacetoxyimidazoline and 1,3-diacetyl-4,5-dipropionyloxyimidazolidine, acylated glycolurils, e.g. tetrapropionylglycoluril or diacetyldibenzoylglycoluril, dialkylated 2,5-diketopiperazines, e.g. 1,4-dipropionyl-2,5-diketopiperazine and 1,4-dipropionyl-3,6-dimethyl-2,5-diketopiperazine and 1,4-dipropionyl-3,6-2,5-diketopiperazine, acetylation and benzoylation products of propylenediurea or 2,2-dimethylpropylenediurea.

The bleaching agents used can also be active chlorine compounds of the inorganic or organic type. Inorganic active chlorine compounds include alkali metal hypochlorites which can be used in particular in the form of their mixed salts and adducts on orthophosphates or condensed phosphates, for example on pyrophosphates and polyphosphates or on alkali metal silicates. If the detergent contains monopersulfates and chlorides, active chlorine will form in aqueous solution.

Organic active chlorine compounds are in particular the N-chlorine compounds where one or two chlorine atoms are bonded to a nitrogen atom and where preferably the third valence of the nitrogen atom leads to a negative group, in particular to a CO or $SO_2$ group. These compounds include dichlorocyanuric and trichlorocyanuric acid and their salts, chlorinated alkylguanides or alkylbiguanides, chlorinated hydantoins and chlorinated melamines.

Examples of additional assistants are: suitable foam regulants, in particular if surfactants of the sulfonate or sulfate type are used, are surface-active carboxybetaines or sulfobetaines and also the above mentioned nonionics of the alkylolamide type. Also suitable for this purpose are fatty alcohols or higher terminal diols.

Reduced foaming, which is desirable in particular for machine washing, is frequently obtained by combining various types of surfactants, for example sulfates and/or sulfonates, with nonionics and/or with soaps. In the case of soaps, the foam inhibition increases with the degree of saturation and the number of carbon atoms of the fatty acid ester; soaps of saturated $C_{20}$—$C_{24}$-fatty acids, therefore, are particularly suitable for use as foam inhibitors.

The nonsurfactant-like foam inhibitors include optionally chlorine-containing N-alkylated aminotriazines which are obtained by reacting 1 mole of cyanuric chloride with from 2 to 3 moles of a mono- and/or dialkylamine having 6 to 20, preferably 8 to 18, carbon atoms in the alkyl. A similar effect is possessed by propoxylated and/or butoxylated aminotriazines, for example, products obtained by addition of from 5 to 10 moles of propylene oxide onto 1 mole of melamine and further addition of from 10 to 50 moles of butylene oxide onto this propylene oxide derivative.

Other suitable nonsurfactant-like foam inhibitors are water-soluble organic compounds, such as paraffins or hafoparaffins having melting points below 100° C., aliphatic $C_8$- to $C_{40}$ -ketones and also aliphatic carboxylic esters which, in the acid or in the alcohol moiety, possibly even both these moieties, contain not less than 18 carbon atoms (for example triglycerides or fatty acid fatty alcohol esters); they can be used in particular in combinations of surfactants of the sulfate and/or sulfonate type with soaps for foam inhibition.

The detergents may contain optical brighteners for cotton, for polyamide, for polyacrylonitrile or for polyester fabrics. Examples of suitable optical brighteners are derivatives of diaminostilbenedisulfonic acid for cotton, derivatives of 1,3-diarylpyrazolines for polyamide, quaternary salts of 7-methoxy-2-benzimidazol-2'-ylbenzofuran or of derivatives form the class of the 7-[1',2',5'-triazol-1'-yl]-3-[1",2", 4"-triazo-1"-y]coumarins for polyacrylonitrile. Examples of brighteners suitable for polyester are products of the class of the substituted styryls, ethylenes, thiophenes, naphthalenedicarboxylic acids or derivatives thereof, stilbenes, coumarins and naphthalimides.

It is preferred that laundry compositions herein also contain enzymes to enhance their through-the-wash cleaning performance on a variety of soils and stains. Amylase and protease enzymes suitable for use in detergents are well known in the art and in commercially available liquid and granular detergents. Commercial detersive enzymes (preferably a mixture of amylase and protease) are typically used at levels of from about 0.001 to about 2 weight percent, and higher, in the present cleaning compositions.

Detergent formulations of this invention may contain minor amounts of other commonly used materials in order to enhance the effectiveness or attractiveness of the product. Exemplary of such materials are soluble sodium carboxymethyl cellulose or other soil redeposition inhibitors; benzotriazole, ethylene thiourea, or other tarnish inhibitors; perfume; fluorescers; dyes or pigments; brightening agents; enzymes; water; alcohols; other builder additives, such as the water soluble salts of ethylenediaminetetraacetic acid, N-(2-hydroxyethyl)-ethylenediaminetriacetic acid; and pH adjusters, such as sodium hydroxide and potassium hydroxide. Other optional ingredients include pH regulants, polyester soil release agents, hydrotropes and gel-control agents, freeze-thaw stabilizers, bactericides, preservatives, suds control agents, fabric softeners especially clays and mixtures of clays with various amines and quaternary ammonium compounds and the like. In the built liquid detergent formulations of this invention, the use of hydrotropic agents may be found efficacious. Suitable hydrotropes include the water-soluble alkali metal salts of toluene sulfonic acid, benzene sulfonic acid, and xylene sulfonic acid. Potassium toluene sulfonate and sodium toluene sulfonate are preferred for this use and will normally be employed in concentrates ranging up to about 10 or 12 percent by weight based on the total composition.

It will be apparent from the foregoing that the compositions of this invention may be formulated according to any of the various commercially desirable forms. For example, the formulations of this invention may be provided in granular form, in liquid form, in tablet form of flakes or powders.

Use of these ingredients is within the skill in the art. Compositions are prepared using techniques within the skill in the art.

The invention will be further clarified by a consideration of the following examples, which are intended to be purely exemplary of the present invention.

EXAMPLE 1

An approximate 0.01M iron (ferric) chelate solution of ethylenediamine N,N'-disuccinic acid (EDDS) was prepared by adding 1.46 grams of EDDS (0.0050 moles) and 200 grams of deionized water to a beaker. The mixture was stirred with a magnetic stirrer bar and the pH was adjusted to approximately 8.7 by the addition of an aqueous ammonia solution. Approximately 2.3 grams of an iron nitrate solution (11.7% iron) from Shepherd Chemical Company was added with stirring. The iron chelate solution (pH=3.1) was diluted in a volumetric flask to a final volume of 500 milliliters with deionized water. Fifty gram aliquots of the above solution were then placed in 20 oz. bottles and the pH adjusted to 5.0, 6.0, 7.0, 8.0, 9.0 and 10.0 by the addition of a few drops of an aqueous ammonia solution. The samples were allowed to stand for 7 days at which time the pH 10 sample had iron hydroxide present. "Overheads" from each of the samples were filtered and analyzed for soluble iron by inductively coupled plasma spectorscopy. The results are given in Table 1.

TABLE 1

| pH | ppm Fe |
|---|---|
| 5 | 514 |
| 6 | 530 |
| 7 | 531 |

TABLE 1-continued

| pH | ppm Fe |
|---|---|
| 8 | 533 |
| 9 | 514 |
| 10 | 181 |

EXAMPLE 2

An approximate 0.01M iron chelate solution of ethylenediamine N-monosuccinic acid (EDMS) was prepared by adding 0.88 grams of EDMS (0.0050 moles) and 200 grams of deionized water to a beaker. The mixture was stirred with a magnetic stirrer bar and approximately 2.3 grams of iron nitrate solution (11.7% iron) was added with stirring. The iron chelate solution (pH=2.3) was diluted in a volumetric flask to a final volume of 500 milliliters with deionized water. Fifty gram aliquots of the solution were placed in 2 oz. bottles and the pH adjusted to 5.0, 6.0, 7.0, 8.0, 9.0 and 10.0 by the addition of a few drops of an aqueous ammonia solution. The samples were allowed to stand for 7 days at which time the pH 9 and 10 samples had iron hydroxide present. "Overheads" from each of the samples were filtered and analyzed for soluble iron by inductively coupled plasma spectroscopy. The results are given in Table 2.

TABLE 2

| pH | ppm Fe |
|---|---|
| 5 | 499 |
| 6 | 501 |
| 7 | 498 |
| 8 | 507 |
| 9 | 6 |
| 10 | 1 |

EXAMPLE 3

In a similar manner to Examples 1 and 2 above, 0.01 molar iron chelate solutions were prepared from various mixtures of EDDS and EDMS. The total amount of chelating agent was held constant at 0.0050 moles. Ratios (molar) of EDDS to EDMS of 90/10, 80/20, 60/40, 40/60, 20/80 and 10/90 were prepared and 50 gram aliquots were adjusted as described earlier. The samples were allowed to stand for 7 days at which time the pH 10 samples at all ratios had iron hydroxide present. In addition, the pH 9 sample at a molar ratio of 10:90 had iron hydroxide present. "Overheads" from each of the samples were filtered and analyzed for soluble iron. The results obtained for the pH 9 samples at each of the ratios is summarized in Table 3. The "expected" value for iron for each ratio is also given as well as the results for EDDS and EDMS. A comparison of the expected ppm iron with the actual values measured demonstrates the synergistic effect obtained from the EDDS/EDMS mixtures. After an additional 17 days, the pH 9 samples at mole ratios of 20:80 and 40:60 had iron hydroxide present. A small amount of iron hydroxide was noted for the 60:40 ratio.

TABLE 3

| EDDS/EDMS Molar Ratio | ppm Fe Expected | ppm Fe Found |
|---|---|---|
| 100/0 | — | 514 |
| 90/10 | 463 | 519 |
| 80/20 | 412 | 508 |
| 60/40 | 311 | 508 |
| 40/60 | 209 | 499 |
| 20/80 | 108 | 526 |
| 10/90 | 57 | 215 |
| 0/100 | — | 6 |

EXAMPLE 4

Samples of EDMS and various isomers of EDDS were tested for biodegradability according to the OECD 301 B Modified Sturm Test. The test measures the $CO_2$ produced by the test compound or standard, which is used as the sole carbon source for the microbes. The following samples were tested:

a) EDMS racemic mixture
b) R,R-EDDS
c) S,S-EDDS
d) EDDS racemic mixture, approx. 25% each R,R-EDDS and S,S-EDDS, and 50% meso-EDDS
e) Sample A: contains 69.8% EDDS racemic mixture, 16.7% EDMS racemic mixture, and 13.5% fumaric acid Each compound was tested at a 20 ppm dose level (based on EDMS or EDDS component active as the acid form). Each compound is evaluated as a series comprising a test vessel, a standard vessel, and a blank vessel. The seed innoculum for each test compound series was obtained from organisms previously exposed to the respective compound in a semi-continuous activated sludge test. The total volume in the vessels was 2100 ml each. To confirm the viability of each seed innoculum, acetic acid was used as the standard at a concentration of 20 ppm in each series. A blank vessel is used to determine the inherent $CO_2$ evolved from each respective innoculum. Carbon dioxide captured in respective barium hydroxide traps was measured at various times during the 28-day test period. The cumulative results of the test are summarized in Table 4.

TABLE 4

Sturm Test Results of EDMS and EDDS Samples

| Test Compound | Theoretical mMoles $CO_2$ | Measured mMoles $CO_2$ | % Theoretical $CO_2$ Produced |
|---|---|---|---|
| EDMS | 1.43 | 1.08 | 75% |
| R,R-EDDS | 1.44 | 0.21 | 14% |
| S,S-EDDS | 1.44 | 1.03 | 72% |
| EDDS rac. mix | 1.44 | 0.43 | 30% |
| Sample A | 2.05 | 1.40 | 68% |
| Acetate Standards | 1.40 | 1.19 ± 0.12 (ave.) | 85% (ave.) |

Sample A was added to the test cell to achieve a 20 ppm level of the active EDDS in the sample. Therefore, the theoretical total of $CO_2$ possible is 1.44 mMoles $CO_2$ from 20 ppm EDDS isomers, plus the theoretical amount of $CO_2$ from EDMS (0.34 mMoles) and the theoretical amount of $CO_2$ from fumaric acid (0.27 mMoles). The total theoretical amount of $CO_2$ possible from this sample is thus 1.44 EDDS+0.34 EDMS+0.27 fumaric=2.05 mMoles $CO_2$.

Using the experimental data in Table 4, the amount of $CO_2$ that would be expected to actually be produced by Sample A can be calculated:

As shown in Table 4, the EDMS produced 75% of the theoretical $CO_2$. The theoretical amount of $CO_2$ possible from the EDMS present in Sample A is 0.34 mMoles. Thus, multiplying the theoretical amount of $CO_2$ that could be produced by the EDMS in Sample A by 75% yields an expected amount of 0.34×0.75=0.26 mMoles.

Since fumaric acid was not determined separately, it is assumed that 95% of theoretical $CO_2$ is produced (this assumes greater $CO_2$ production than the acetate standard, which is highly unlikely) as a conservative estimate. The theoretical amount of $CO_2$ possible from the fumaric acid present in Sample A is 0.27 mMoles. Thus, multiplying the theoretical amount of $CO_2$ that could be produced by the fumaric acid in Sample A by 95% yields an expected amount of 0.27×0.95=0.26 mMoles.

From Table 4, the EDDS racemic mixture produced 30% of theoretical $CO_2$. The theoretical amount of $CO_2$ from the EDDS in Sample A is 1.44 mMoles. Therefore, the expected amount of $CO_2$ produced from the EDDS portion of Sample A is 1.44×0.3=0.43 mMoles, as given in Table 4.

Adding the amounts of $CO_2$ expected from the EDMS, fumaric and EDDS in Sample A, the total amount is 0.26 mMoles $CO_2$ from EDMS +0.26 mMoles $CO_2$ from fumaric +0.43 mMoles $CO_2$ from EDDS isomers=0.95 mMoles $CO_2$. Dividing the expected amount (0.95 mMoles $CO_2$) by the theoretical amount (2.05 mMoles $CO_2$) gives an expected % theoretical $CO_2$ produced of 46%. The amount observed is a total of 68% of theoretical.

These results are further summarized in Table 5.

TABLE 5

Expected vs Observed $CO_2$ Production in Sample A

| Compound in Sample A | Theoretical mMoles $CO_2$ | Expected mMoles $CO_2$ | % Theor $CO_2$ Expected |
|---|---|---|---|
| EDMS | 0.34 | 0.26 | 75% |
| fumaric acid | 0.27 | 0.26 | 95% |
| EDDS rac. mix | 1.44 | 0.43 | 30% |
| | | Predicted Total | |
| | 2.05 | 0.95 | 46% |
| | | Observed Total | |
| | 2.05 | 1.40 | 68% |

Another way to evaluate the data is to calculate the amount of $CO_2$ that would be expected from only the EDDS portion of Sample A.

From Table 5, the expected amount of $CO_2$ from the EDDS in Sample A is 0.43 mMoles, based on experimental measurements of the EDDS racemic mixture.

The expected amount of $CO_2$ from the EDMS portion of the sample is 0.26 mMoles and the expected amount of $CO_2$ from the fumaric acid portion is 0.26 mMoles. If the amounts of expected $CO_2$ from EDMS and fumaric acid are subtracted from the observed amount of $CO_2$ produced, we are left with the amount of $CO_2$ produced by the EDDS portion of the sample=1.40 mMoles (total $CO_2$ produced by Sample A)−0.26 mMoles (predicted amount of $CO_2$ produced from EDMS in Sample A) −0.26 mMoles (predicted amount of $CO_2$ produced from fumaric in Sample A)=0.88 mMoles $CO_2$ produced by the EDDS portion of Sample A.

The theoretical amount of $CO_2$ possible from the EDDS portion of Sample A is 1.44 mMoles $CO_2$. Therefore, the predicted (and experimentally measured) % theoretical $CO_2$ produced is 0.43 mMoles divided by 1.44 mMoles=30%. However, in these tests, the observed % theoretical $CO_2$ produced calculated for the EDDS portion of Sample A is 0.88 mMoles. Dividing 0.88 mMoles by the theoretical 1.44 mMoles=61% theoretical $CO_2$ produced by the EDDS portion of Sample A. A value of greater than 60% of the theoretical amount of $CO_2$ produced in this test indicates that a compound is readily biodegradable. The experimentally measured value for the EDDS portion of Sample A is 30%.

The data for the EDDS portion of Sample A indicates that from a biodegradability standpoint, it appears to be an advantage to have a mixture of EDDS and EDMS vs EDDS alone. Table 6 summarizes the above calculations.

TABLE 6

Expected vs Observed $CO_2$ Produced from EDDS in Sample A

| | mMoles $CO_2$ | % of Theoretical $CO_2$ |
|---|---|---|
| Predicted amount $CO_2$ expected from EDDS portion of Sample A | 0.43 | 30% |
| "Observed" amount of $CO_2$ produced from EDDS portion of Sample A | 0.88 | 61% (from EDDS only) |

EXAMPLE 5

Ratios (molar) of EDDS to EDMS of 90/10, 80/20, 60/40, 40/60, 20/80 and 10/90 were prepared and titrated with 0.01M copper solution using Murexide as the indicator. The chelant mixtures were all found to complex copper on an equivalent (equimolar) basis.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A composition for chelating a metal comprising at least one polyamino disuccinic acid and at least one polyamino monosuccinic acids wherein the mole ratio of polyamino disuccinic acid to the polyamino monosuccinic acid is from 99:1 to about 5:95.

2. The composition of claim 1 wherein the metal is iron.

3. The composition of claim 2 wherein the polyamino disuccinic acid has from 2 to about 6 nitrogen atoms, the nitrogen atoms being separated by alkylene groups of from 2 to about 12 carbon atoms each.

4. The composition of claim 3 wherein, in the polyamino disuccinic acid, the two nitrogens to which succinic acid or salt groups are attached also have hydrogen as one substituent thereon.

5. The composition of claim 4 wherein the polyamino disuccinic acid is selected from ethylenediamine-N-N'-disuccinic acid, diethylenetriamine-N-N"-disuccinic acid, triethylenetetraamine-N-N'"-disuccinic acid, 1,6-hexamethylenediamine-N,N-disuccinic acid, tetraethylenepentamine-N-N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, and combinations thereof.

6. The composition of claim 5 wherein the polyamino disuccinic acid is ethylenediamine-N,N'-disuccinic acid.

7. The composition of claim 2 wherein the polyamino monosuccinic acid has from 2 to about 6 nitrogen atoms, the nitrogen atoms being separated by alkylene groups of from 2 to about 12 carbon atoms each.

8. The composition of claim 7 wherein, in the polyamino monosuccinic acid, the nitrogen to which the succinic acid or salt group is attached also has hydrogen as one substituent thereon.

9. The composition of claim 8 wherein the polyamino monosuccinic acid is selected from ethylenediamine-N-monosuccinic acid, diethylenetriamine-N-monosuccinic acid, triethylenetetraamine-N-monosuccinic acid, 1,6-hexamethylenediamine-N-monosuccinic acid, tetraethylenepentamine-N-monosuccinic acid, 2-hydroxypropylene-1,3-diamine-N-monosuccinic acid, 1,2-propylenediamine-N-monosuccinic acid, 1,3-propylenediamine-N-monosuccinic acid, cis-cyclohexanediamine-N-monosuccinic acid, trans-cyclohexanediamine-N-monosuccinic acid, and ethylenebis (oxyethylenenitrilo)-N-monosuccinic acid.

10. The composition of claim 9 wherein the polyamino monosuccinic acid is ethylenediamine-N-monosuccinic acid.

11. The composition of claim 1 wherein the polyamino substituent of the polyamino disuccinic acid and polyamino monosuccinic acid are the same.

12. The composition of claim 11 wherein the polyamino disuccinic acid is ethylenediamine-N,N'-disuccinic acid and the polyamino monosuccinic acid is ethylenediamine-N-monosuccinic acid.

* * * * *